United States Patent [19]

Neeb et al.

[11] 3,940,782

[45] Feb. 24, 1976

[54] DIAZOTYPE DEVELOPING APPARATUS WITH LIQUID METERING ASSEMBLY

[75] Inventors: Robert P. Neeb, Wake Forest; Henry W. Patrick; Ray H. Mumford, both of Raleigh, all of N.C.

[73] Assignee: Diazit Company, Inc., Youngsville, N.C.

[22] Filed: Sept. 10, 1974

[21] Appl. No.: 504,752

[52] U.S. Cl. ..... 354/318; 118/261; 118/259; 101/366

[51] Int. Cl.[2] ..... G03D 5/06

[58] Field of Search ..... 354/318, 317; 118/261, 118/259, 413; 101/363, 366

[56] References Cited

UNITED STATES PATENTS

| | | | |
|---|---|---|---|
| 3,202,532 | 8/1965 | Labombarde | 118/261 X |
| 3,565,035 | 2/1971 | Burgess et al. | 118/259 X |
| 3,704,662 | 12/1972 | Johnson et al. | 354/318 |

*Primary Examiner*—Robert P. Greiner
*Attorney, Agent, or Firm*—Samuelson & Jacob

[57] ABSTRACT

Apparatus for developing exposed diazotype sheet material in which an accurately metered amount of liquid developer is applied to the sheet material by an applicator roller. The roller surface is essentially smooth and liquid developer is applied to the roller surface in an amount metered by a metering blade assembly which includes a flexible support member carrying a resilient backing layer which, in turn, carries a fine mesh screen held in contact with the smooth surface of the roller. A sheet of smooth, essentially continuous material is interposed between the screen and the roller surface when the apparatus is not in use and is retracted to enable direct contact between the screen and the roller surface when the apparatus is in use.

16 Claims, 3 Drawing Figures

DIAZOTYPE DEVELOPING APPARATUS WITH LIQUID METERING ASSEMBLY

The present invention relates generally to diazotype developing apparatus and pertains, more specifically, to a liquid metering arrangement for applying an accurately determined amount of liquid developer to a sheet of exposed diazotype material.

Recent developments in diazotype developing apparatus have emphasized the desirability of applying well-controlled, very small amounts of liquid developer to sheets of exposed diazotype material for the convenient production of immediately usable copy.

One scheme in present use for attaining such copy is to apply the liquid developer to the sheet of exposed diazotype material with an applicator roller having a resilient surface including random small depressions. Liquid developer is applied to the roller surface in excess of the desired amount and the excess fluid is wiped or scraped from the surface, leaving behind, within the random depressions, only the desired small amount of developer which is to be applied to the sheet. It is immediately apparent that control of the amount of liquid thus applied is a direct function of the size and number of the depressions in the roller surface and accuracy is obtained only through careful control in the manufacture of the roller applicator.

It would be advantageous to be able to attain accurate control of the amount of liquid developer applied to exposed sheets of diazotype material using a roller applicator, but independent of any particular requirements for depressions in the roller surface.

It is therefore an object of the invention to provide a diazotype developing apparatus with a liquid metering arrangement which applies accurately determined small amounts of liquid developer to an applicator roller, the surface of which is essentially smooth, and which, in turn, applies the liquid evenly to exposed diazotype sheet material.

Another object of the invention is to provide a diazotype developing apparatus with a liquid metering arrangement in which a metering blade assembly includes a fine mesh screen in contact with an essentially smooth-surfaced roller applicator for accurately controlling the amount of liquid developer placed on the roller surface and applied by the roller to exposed diazotype sheet material.

Still another object of the invention is to provide apparatus of the type described and in which the metering blade assembly includes a layer of resilient material beneath the fine mesh screen for added control of the amount of liquid developer applied to the roller surface and for resiliently conforming the screen to the contour of the roller surface along a limited area thereof.

A further object of the invention is to provide apparatus of the type described and in which a sheet of smooth, essentially continuous material is interposed between the fine mesh screen and the roller surface when the apparatus is not in use and is retracted to enable direct contact between the screen and the roller during use.

A still further object of the invention is to provide a relatively simple and economically manufactured liquid metering arrangement for applying accurately determined small amounts of liquid developer to exposed diazotype sheet material in a diazotype developing apparatus.

The above objects, as well as still further objects and advantages, are attained by the invention which may be described briefly as an apparatus for developing exposed diazotype sheet material by applying a predetermined amount of liquid developer to the sheet material, the apparatus comprising a frame, an applicator roller mounted for rotation in a given direction upon the frame, the roller having a generally cylindrical surface, a metering blade assembly mounted upon the frame and urged against the surface of the applicator roller, means for supplying liquid developer at a first area of the roller surface located before the metering blade assembly in a direction opposite to the given direction, and means for urging the sheet material against a second area of the roller surface located beyond the metering blade assembly in the given direction, the metering blade assembly including a fine mesh screen biased into direct contact with a portion of the roller surface between the first and second areas for metering the supplied liquid developer to establish an accurately determined amount of liquid developer upon the surface of the roller as the surface passes across the screen.

The invention will be more fully understood, while still further objects and advantages will become apparent, in the following detailed description of preferred embodiments of the invention illustrated in the accompanying drawing, in which.

Figure 1:
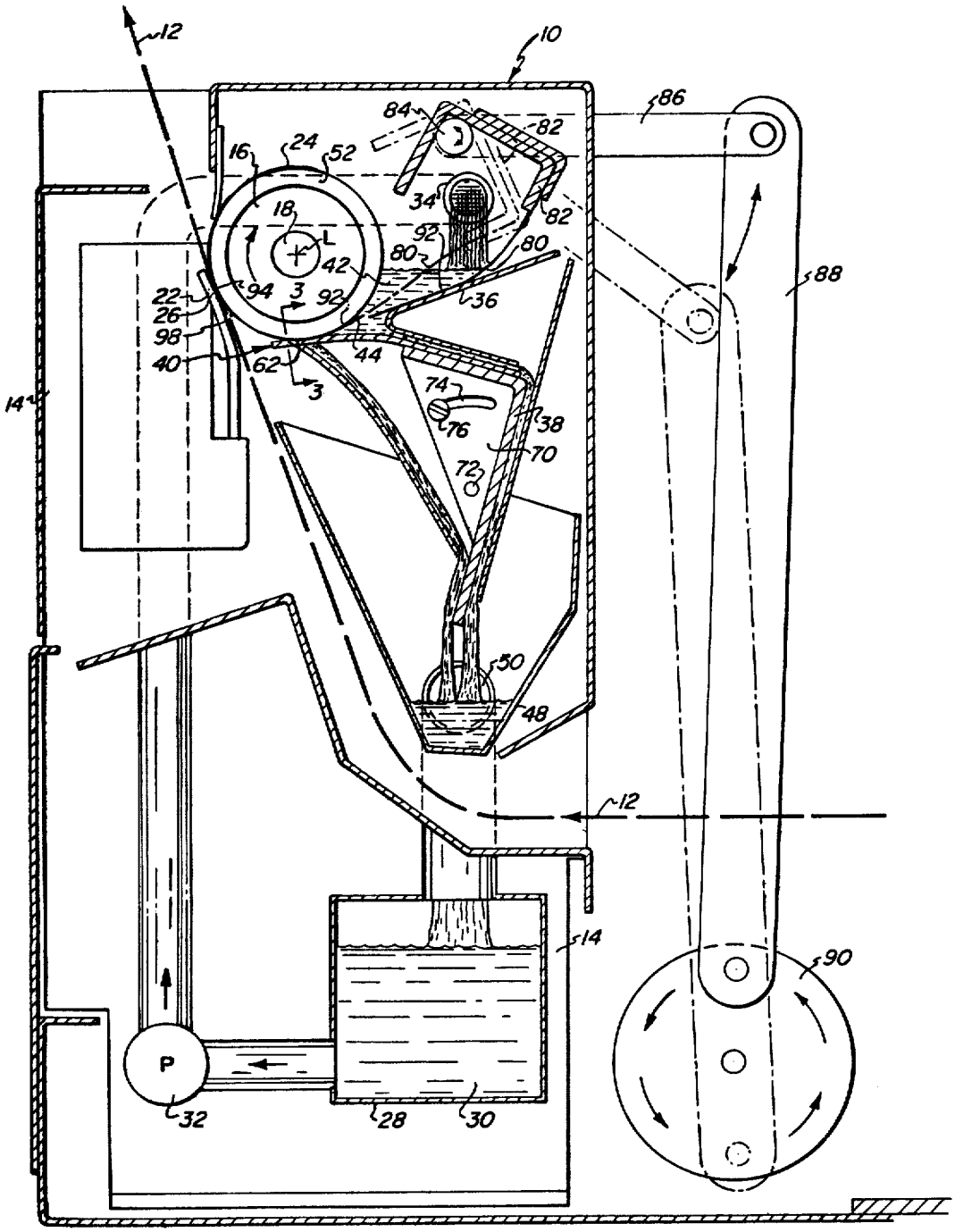
FIG. 1 is a largely diagrammatic, transverse cross-sectional view of a diazotype developing apparatus constructed in accordance with the invention.
Figure 2:
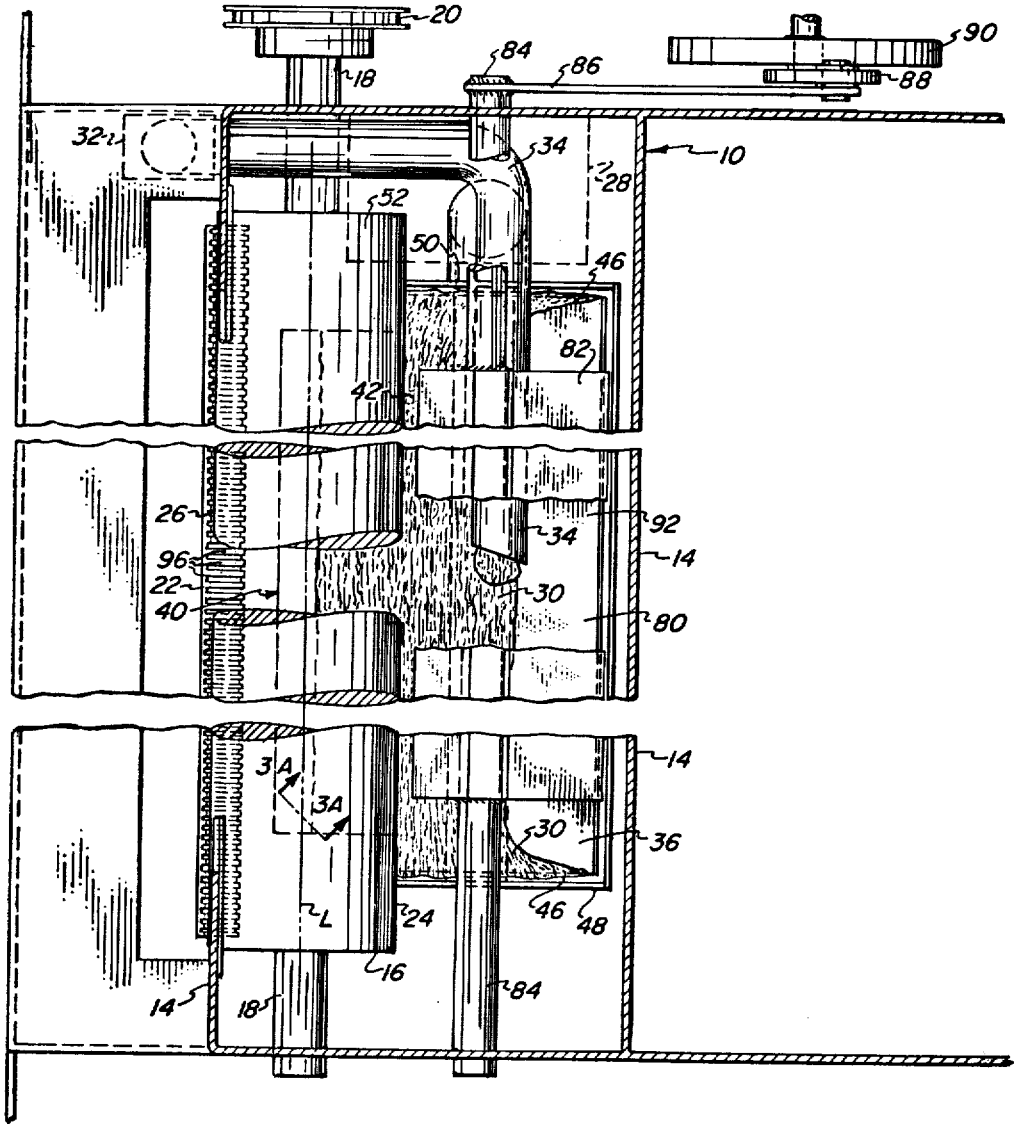
FIG. 2 is a largely diagrammatic, partially cut-away plan view of the apparatus.

Referring now to the drawing, and especially to FIGS. 1 and 2 thereof, there is illustrated, largely diagrammatically, a diazotype developing apparatus 10 for developing exposed diazotype sheet material which follows a path of travel 12 through apparatus 10. Apparatus 10 includes a frame 14 upon which the major working components of the apparatus are mounted. Thus, an applicator for applying liquid developer to the exposed diazotype sheet material is shown in the form of an applicator roller 16 carried by a shaft 18 which is journalled for rotation in frame 14 and carries a drive pulley 20 (see FIG. 2) ordinarily driven by an electric motor (not shown) to rotate the applicator roller 16 in a clockwise direction, as indicated by the arrow in FIG. 1.

Means, shown in the form of a resilient guide blade 22 mounted upon the frame 14, is provided for urging the diazotype sheet material against the surface 24 of the applicator roller 16 at area 26 of surface 24 in such a manner that the sheet material is driven by the roller 16 along the path of travel 12 in the direction indicated by arrowheads in FIG. 1.

Means is also provided for applying a liquid developer to the surface 24 of the applicator roller 16 and is seen to include a reservoir 28 of liquid developer 30, mounted upon the frame 14, and a pump 32 for delivering the liquid developer 30 through an inlet tube 34 to a tray 36 located adjacent the applicator roller 16. The tray 36 is carried by a bracket 38, also mounted upon the frame 14 in a manner which will be described in more detail below. Affixed to the bracket 38 is a metering blade in the form of metering blade assembly 40 which is urged against the surface 24 of applicator roller 16 and, together with tray 36, enables the liquid developer 30 to build up and establish a puddle 42 of liquid developer which wets the contacted surface area 44 of the roller surface 24. A sufficient volume of liquid developer 30 is supplied by pump 32 and inlet tube 34 to maintain a puddle 42 large enough to place an adequate amount of liquid developer 30 at the surface area 44 of the applicator roller 16. As best seen in FIG. 2, the liquid developer 30 overflows over the ends 46 of tray 36 and drops down, as shown in FIG. 1, by gravity, into a trough 48 and thence through a drain 50 back into the reservoir 28.

The metering blade assembly 40 is located between the wetted surface area 44 of the roller surface 24 and the sheet material contact area 26 of the roller surface 24 in order to enable the metering blade assembly 40 to establish an accurately determined amount of liquid developer upon the surface of the roller and to enable the roller to apply only a predetermined desired amount of liquid developer to the diazotype sheet material. The cooperation between the metering blade assembly and the surface of the roller becomes very critical where it is desired to apply very small amounts of accurately measured liquid developer to the sheet material.

It has been suggested that such very small amounts of liquid can be measured accurately by providing the roller surface with randomly formed small depressions which will become filled with the appropriate amount of liquid, any excess liquid being scraped from the remainder of the roller surface by a relatively smooth metering blade making intimate contact with the roller.

Figure 3:
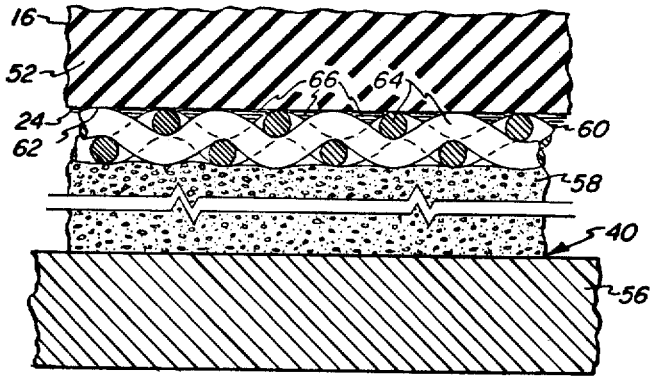
FIG. 3 is a very much enlarged cross-sectional view taken along line 3—3 of FIG. 1 or, alternately, in another embodiment of the invention, taken along line 3A—3A of FIG. 2.

In the present apparatus 10, the roller 16 is provided with a somewhat resilient cover 52 with a relatively smooth surface 24. Preferably, surface 24 is as smooth a surface, i.e., free of depressions, as can be obtained economically. The metering blade assembly 40 then operates to meter the liquid developer to establish accurately the appropriate amount of liquid developer upon the surface of the roller, as the roller surface emerges from contact with the metering blade assembly, by virtue of the composite structure of the metering blade assembly, which is best illustrated in FIG. 3. Thus, the composite structure of the metering blade assembly 40 includes a resiliently flexible support member 56 which carries a resilient backing member in the form of resilient layer 58 which, in turn, carries a fine mesh screen 60. The screen 60 is urged against the surface 24 of the applicator roller 16 along portion 62 of that surface with a biasing force just great enough to enable retention of the appropriate amount of liquid developer on the surface of the roller. The resilient backing layer 58 enables the screen 60 to be conformed somewhat to the portion 62 of the roller surface 24 for optimum metering.

Preferably, the flexible support member is constructed of a durable, resilient material, such as spring steel, and may be thin relative to the resilient backing layer which preferably is constructed of a foam plastic material, such as a closed cell Neoprene foam. The screen is thinner than either the flexible support member or the resilient backing layer and preferably is woven from filaments of relatively hard material, preferably in the form of a synthetic resin material such as nylon or a metallic material such as stainless steel. In a typical metering blade assembly 40, the flexible support member 56 has a thickness of 0.005 inch, the resilient backing layer a thickness of 0.060 inch and the screen 60 has a thickness of 0.0025 inch.

As best seen in FIG. 3, where the screen 60 is woven from filaments 64, small passages 66 are created which enable the metering blade assembly 40 to meter the liquid developer accurately and this provides the desired small amounts of liquid developer to the roller surface which then carries the appropriate amount of liquid developer to the diazotype sheet material. By employing different diameter filaments 64 and different filament spacing, the amount of liquid developer allowed to remain on the surface of the roller may be varied. Woven materails found suitable for use as screen 60 in the metering blade assembly 40 are chosen by "mesh", which indicates the number of filaments per inch, and "opening" or wire diameter" either of which designates the size of the opening formed by the weave of a particular mesh size. Since the screen 60 preferably is woven in the form of orthogonal filaments 64, the opening is a square or rectangular opening. Table A below indicates typical rates of application of liquid developer obtained with various nylon screens while Table B indicates application rates available with stainless steel screens. All application rates are based upon a linear speed of the diazotype sheet material of 12 feet per minute.

TABLE A

| NYLON SCREEN | | |
|---|---|---|
| Mesh | Opening (Microns) | Application Rate (Grams/Square Meter) |
| 170 | 88 | 5.0 |
| 200 | 74 | 4.0 |
| 230 | 62 | 3.6 |
| 270 | 53 | 3.3 |
| 325 | 44 | 2.9 |
| 400 | 37 | 2.5 |
| 517 × 412 | 7 | 1.6 |

TABLE B

| STAINLESS STEEL SCREEN | | |
|---|---|---|
| Mesh | Wire Diameter (Inches) | Application Rate (Grams/Square Meter) |
| 200 | 0.0021 | 12.3 |
| 250 | 0.0016 | 7.1 |
| 325 | 0.0011 | 5.4 |

The application rate with any particular mesh screen can be varied within a narrow range by selectively adjusting the biasing force with which the screen is urged against the surface of the applicator roller. For example, the application rate obtained with the 250 mesh stainless steel screen set forth in Table B above can be varied over the range of 5.8 to 8.7 grams per square meter depending upon the biasing force employed. An increase in the biasing force decreases the rate of application as a result of the screen becoming more embedded in the resilient backing layer with a concomitant decrease in the area available for passing liquid developer along the roller surface. In this manner, an overlap of ranges is available among different mesh screens enabling the selection of an infinite number of application rates. As seen in FIG. 1, means for selectively adjusting the biasing force is provided by the way in which bracket 38 is mounted upon the frame 14. Thus, bracket 38 includes a web 70 through which a pin 72 passes to mount the bracket 38 for pivotal movement about pin 72 relative to the frame. An arcuate slot 74 in the web 70 receives a clamping screw 76 threaded into the frame. Upon loosening of screw 76, web 70, and bracket 38, can be swung around pin 72 to move metering blade assembly 40 toward or away from the applicator roller 16, thereby varying the flexure of flexible support member 56 and the biasing force with which screen 60 is urged against the surface 24 of roller 16. Tightening of screw 76 will clamp the bracket in place at a selected position corresponding to a selected biasing force.

The wetting and self-leveling properties of the developer fluid, together with the large number of very small passages provided by the screen enable the liquid developer to form a suitable thin film over the roller surface 24 between the portion 62 and the area 26 for even application to the diazotype sheet material.

Application rate may be varied with any chosen screen by changing the orientation of the screen relative to the roller surface. Thus, in the cross-section taken along line 3—3 of FIG. 1, the orthogonal filaments 64 are oriented parallel to and perpendicular to the longitudinal axis L of the cylindrical surface 24 of applicator roller 16. In the alternate embodiment illustrated by the cross-section taken along line 3A—3A of FIG. 2, the filaments 64 are oriented at 45°to the axis L. All other parameters remaining equal, a higher application rate is attained where the filaments of the screen are oriented parallel ad perpendicular, as in the former illustration, while a lower application rate is attained where the filaments are oriented diagonally, as in the latter illustration.

Returning now to FIGS. 1 and 2, it has been noted that when apparatus 10 is not in use and remains as rest, the pressure of the screen 60 against the resilient cover 52 of the stationary roller 16 tends to form minute temporary impressions in the surface 24 of the roller. While these impressions will tend to work themselves out once the apparatus is started and roller 16 is rotated, the presence of the impressions causes the apparatus to emit objectionable noises in the initial stages of operation. In order to eliminate such noises, apparatus 10 is provided with means for precluding the formation of unwanted impressions in the roller surface 24 due to the pressure of the screen 60.

Thus, a sheet 80 of relatively hard, flexible material is affixed to a support 82 which is mounted upon a shaft 84 journalled in the frame 14. An arm 86 connects the shaft 84 to a link 88 pinned to a crank 90. The crank 90 may be rotated through one-half a revolution to move the crank between a first position, where the link 88, the arm 86 and the support 82 are in the position shown in phantom in FIG. 1, to place sheet 80 between the metering blade assembly 40 and the roller surface 24, and a second position, where the link, arm and support are in the position shown in full lines in FIG. 1 and the sheet 80 is withdrawn from between the metering blade assembly and the roller surface. Thus, in the first position of the sheet 80, the sheet is interposed between the screen 60 and the cover 52 of the roller, while in the second position of the sheet 80, the sheet is withdrawn and the screen 60 can engage the cover 52.

When the apparatus 10 is not operating, the crank is moved to the first position and the sheet 80 is interposed between the screen 60 and the roller surface 24. At least the upper surface 92 of sheet 80, which confronts and contacts roller surface 24, is relatively smooth and continuous and the material of sheet 80 is hard enough to preclude the formation of impressions upon the surface of the roller by the screen when the sheet is thus interposed. When apparatus 10 is to be operated, the crank is rotated to the second position and the sheet 80 is withdrawn to enable normal operation of the apparatus.

An added advantage attained by insertion of sheet 80 between the metering blade assembly 40 and the roller 16 upon completion of the operation of apparatus 10 is that the sheet will tend to expell any foreign matter which may have accumulated between the metering blade assembly and the roller during use.

Sheet 80 is best fabricated from a semi-rigid material which presents the appropriate surface quality and enables the desired insertion while permitting the necessary flexure. A suitable sheet 80 has been fabricated of a synthetic resin material such as a polyester resin.

Guide blade 22 preferably is grooved along the surface 94 thereof which confronts the roller surface 24, with grooves 96 oriented generally parallel with the direction of movement of the roller surface, as viewed at the guide blade, the grooves 96 being open to the roller surface 24, all as seen in FIG. 2. Thus, during those periods when apparatus 10 is operated with roller 16 rotating and with no sheet of diazotype material passing between the guide blade 22 and the roller surface 24, the liquid developer which ordinarily would be applied to the sheet of diazotype material can pass through the grooves 96 and an unwanted excessive amount of liquid developer will not accumulate in the entrance 98 to the nip between the guide blade and the roller surface.

It is to be understood that the above detailed description of embodiments of the invention are provided by way of example only. Various details of design and construction may be modified, without departing from the true spirit and scope of the invention, as set forth in the appended claims.

The embodiments of the invention in which an exclusive property or privilege is claimed are defined as follows:

1. Apparatus for developing exposed diazotype sheet material by applying a predetermined amount of liquid developer to the sheet material, said apparatus comprising:

a frame;

an applicator roller mounted for rotation in a given direction upon the frame, said roller having a generally cylindrical surface;

a metering blade assembly mounted upon the frame and urged against the surface of the applicator roller;

means for supplying liquid developer at a first area of the roller surface located before the metering blade assembly in a direction opposite to said given direction; and means for urging the sheet material against a second area of the roller surface located beyond the metering blade assembly in said given direction;

said metering blade assembly including a fine mesh screen biased into direct contact with a portion of the roller surface between the first and second areas for metering the supplied liquid developer to establish an accurately determined amount of liquid developer upon the surface of the roller as the surface passes across the screen.

2. The invention of claim 1 wherein the metering blade assembly includes:

a flexible support member; and a resilient backing member carried by the support member;

said fine mesh screen being carried by the resilient backing member and being resiliently urged against said portion of the roller surface by the resilient backing member.

3. The invention of claim 1 wherein the roller surface is essentially smooth.

4. The invention of claim 3 wherein the means for urging the sheet material against the second area of the roller surface includes a guide blade having a surface confronting the roller surface and grooves in said guide blade surface oriented generally parallel to the direction of movement of said second area of the roller surface and open to the roller surface.

5. The invention of claim 1 including means for selectively varying the force with which the screen is biased into contact with the roller surface.

6. The invention of claim 1 wherein the roller surface is essentially smooth and the metering blade assembly includes:

a flexible support member; and a resilient backing member carried by the support member;

said fine mesh screen being carried by the resilient backing member and being resiliently urged against said portion of the roller surface by the resilient backing member.

7. The invention of claim 6 wherein the screen is fabricated of a material which is harder than the resilient backing member.

8. The invention of claim 7 wherein the backing member is fabricated of a closed cell foam plastic material.

9. The invention of claim 7 wherein the screen is a woven material having orthogonal filaments.

10. The invention of claim 9 wherein the screen is oriented relative to the cylindrical surface of the roller such that some of the filaments are parallel to the longitudinal axis of the cylindrical surface while others are perpendicular to said axis.

11. The invention of claim 9 wherein the screen is oriented relative to the cylindrical surface of the roller such that the filaments make an angle of about 45° with the longitudinal axis of the cylindrical surface.

12. The invention of claim 9 wherein the filaments are fabricated of a synthetic resin material, such as nylon.

13. The invention of claim 9 wherein the filaments are fabricated of a metallic material, such as stainless steel.

14. The invention of claim 1 including:

a sheet having at least one surface which is relatively smooth and continuous; and means mounting the sheet upon the frame for movement between a first position, wherein the sheet is interposed between the screen and the surface of the roller, with said one surface of the sheet confronting the surface of the roller, and a second position, wherein the sheet is withdrawn from between the screen and the surface of the roller;

the sheet being hard enough to preclude the formation of unwanted impressions upon the surface of the roller by the screen when the sheet is in the first position.

15. Apparatus for developing exposed diazotype sheet material by applying a predetermined amount of liquid developer to the sheet material, said apparatus comprising:

a frame;

an applicator roller mounted for rotation in a given direction upon the frame, said roller having a generally cylindrical surface;

a metering blade mounted upon the frame and urged against the surface of the roller;

means for supplying liquid developer at a first area of the roller surface located before the metering blade in a direction opposite to said given direction;

means for urging the sheet material against a second area of the roller surface located beyond the metering blade in said given direction;

a sheet having at least one surface which is relatively smooth and continuous; and means mounting the sheet upon the frame for movement between a first position, wherein the sheet is interposed between the metering blade and the surface of the roller, with said one surface of the sheet confronting the surface of the roller, and a second position, wherein the sheet is withdrawn from between the metering blade and the surface of the roller; the sheet being hard enough to preclude the formation of unwanted impressions upon the surface of the roller by the metering blade when the sheet is in the first position.

16. The invention of claim 15 wherein the sheet is fabricated of a synthetic resin material, such as a polyester resin.

* * * * *